US007401693B2

(12) United States Patent
Stuffel et al.

(10) Patent No.: US 7,401,693 B2
(45) Date of Patent: Jul. 22, 2008

(54) MOVING FLANGE FASTENING FOR PASSENGER CONVEYORS

(75) Inventors: Andreas Stuffel, Bückeburg (DE); Georg Warmbold, Rodenberg (DE)

(73) Assignee: Otis Elevator Company, Farmington, CT (US)

( * ) Notice: Subject to any disclaimer, the term of this patent is extended or adjusted under 35 U.S.C. 154(b) by 261 days.

(21) Appl. No.: 10/544,760

(22) PCT Filed: Feb. 7, 2003

(86) PCT No.: PCT/EP03/01254

§ 371 (c)(1), (2), (4) Date: Aug. 5, 2005

(87) PCT Pub. No.: WO2004/069724

PCT Pub. Date: Aug. 19, 2004

(65) Prior Publication Data

US 2006/0254879 A1 Nov. 16, 2006

(51) Int. Cl.
*B66B 23/12* (2006.01)

(52) U.S. Cl. ..... 198/333; 198/326

(58) Field of Classification Search ..... 198/321, 198/326, 327, 333

See application file for complete search history.

(56) References Cited

U.S. PATENT DOCUMENTS 2,292,534 A * 8/1942 Margles ..... 198/333
2,346,266 A 4/1944 Mentley
3,986,595 A 10/1976 Kamioka et al.
4,470,497 A 9/1984 Kraft
6,213,278 B1 * 4/2001 Tanigawa ..... 198/333
6,450,316 B1 * 9/2002 Stuffel et al. ..... 198/326
6,868,956 B2 * 3/2005 Hauer et al. ..... 198/333
7,140,484 B2 * 11/2006 Stuffel et al. ..... 198/333

FOREIGN PATENT DOCUMENTS

WO WO 02 44072 A 6/2002

OTHER PUBLICATIONS

PCT International Search Report for PCT/EP03/01254, dated Oct. 23, 2003.

International Preliminary Examination Report for PCT/EP03/01254, dated Oct. 15, 2004.

* cited by examiner

*Primary Examiner*—James R Bidwell

(57) ABSTRACT

A passenger conveyor including an endless conveyor band having a plurality of tread elements connected to and driven by a drive chain at each lateral edge thereof and a moving flange moving in use together with the conveyor band. The moving flange includes a plurality of discs attached to the tread elements and a plurality of bridges each attached between two consecutive discs. At least one bridge is attached to the drive chain by a pin and socket connection and a resilient locking element is arranged so as to bias in use the bridge against the chain.

10 Claims, 4 Drawing Sheets

MOVING FLANGE FASTENING FOR PASSENGER CONVEYORS

FIELD OF THE INVENTION

The present invention relates to passenger conveyors including an endless conveyor band.

DESCRIPTION OF THE RELATED ART

Such a passenger conveyor is known for example from WO 02/44072 A1. Escalators and moving walkways are typical examples of such passenger conveyors. An escalator usually contains a series of movable interconnected tread elements that are referred to as "steps" and driven around upper and lower chain reversing wheels or other reversal constructions by a driving motor. These interconnected steps are referred to as a passenger conveyor band or step band. Similarly, moving walkways contain several interconnected pallets that are also driven such that they revolve around two chain reversal constructions. In moving walkways of this type, the passenger conveyor band is usually referred to as a pallet band.

With the passenger conveyor of WO 02/44072 a moving flange is provided at each lateral edge of the tread element extending upwards from the tread surface so as to avoid any relative movement between the tread surface of the tread element and a fixed skirt laterally adjacent thereto. Such flange excludes any entrapment in the gap between the moving tread elements and the fixed skirt which is possible in constructions without such moving flange or moving skirt. Particularly, the moving flange is formed of an alternating series of first flange parts connected to the tread elements which are referred to as "discs" and second flange part which are arranged between subsequent discs and which are referred to as "bridges". The discs and bridges are arranged consecutive next to each other so that they form a substantially continuous moving flange. A tight gap is provided between the discs and bridges in order to allow relative movement there between, particularly with escalators. An inner decking covers the upper edge of the moving flange. The inner decking typically extends from the balustrade downwards a certain distance beyond the upper edge of the moving flange.

While the moving flange greatly enhances the safety of passenger conveyors as compared to conventional designs, it poses a new problem for the engineers in this field. While the discs are securely attached to the tread elements, it is a difficult task to safely secure the moving bridges as well. Particularly, the moving bridges have to be attached to any moving part so that it is impossible for the bridges to get lost from the moving flange. In case a bridge gets lost, an "opening" is travelling along with the moving flange with the high risk that any objects are entrapped at the exit landing where the opening "disappears". Therefore, a reliable and secure mount of the bridges is mandatory.

On the other hand, as described in WO 02/44072, easy removal of the individual tread element for maintenance purposes is also of great concern. The removal of the tread elements requires the disassembly of the inner decking, the dismounting of the bridges in contact with the respective step and subsequent removal of the step as described in this document. These two objects, i.e. safe securement and easy disassembly, are somewhat in contradiction to each other.

The engineers of the applicant have contemplated different solutions for the bridge mounting. One solution was to mount the bridge by way of a threaded bolt directly to a chain link. However, threads in the chain link which is die cast from aluminium material, have a limited lifetime only. This reduced lifetime is a problem, as one can expect dismounting of a bridge several times during the conveyor's lifetime. On the other hand, the bolt is a separate component which can get lost during assembly and disassembly, fall into the interior of the conveyor and might cause harm therein. Moreover, there is a limited space available at this location resulting in that the bolt has to be positioned very closely to the inner surface of the bridge. However, in order to provide the required structural stiffness of the bridge part, stiffening ribs are provided at the inner surface thereof. The bolt mount requires to have a bore through such stiffening ribs at the central portion thereof which tends to weaken the bridge. Moreover, a bolt has to be tightened with a certain tightening moment. This increases the risk for incorrect assembly.

SUMMARY OF THE INVENTION

Exemplary embodiments of the invention provide a reliable, fail safe attachment mechanism for a bridge without any loose parts. In addition, the attachment mechanism can be mounted and dismounted with simple tools.

Exemplary embodiments of the passenger conveyor include at least one bridge that is attached to the drive chain by means of a pin and socket connection and that a resilient locking element is arranged so as to bias in use the bridge against the chain.

Preferably all the bridges are attached to the drive chain in this manner. The resilient locking element provides for a clearance-free attachment of the bridge. Moreover, this element can be made so as to provide a clearly audible noise once the bridge safely snaps in. This avoids any incorrect mount by the service technicians. The resilient locking element can be constructed so as to be operable by a simple tool, for example a screw driver, etc. Moreover, no loose parts are required.

Preferably, the pin is attached to a chain link, while the socket is attached to the bridge. With such a construction, the bridge can easily be slid onto the pin even without any tools. Preferably the pin is threaded into the chain link. This is a relatively easy mount. The chain link is to be machined very intensively anyhow after die casting, as it has to keep close tolerances, thus machining a thread bore is not substantially increasing costs and machining time. A "one-time" thread connection is a relatively secure connection for the link. Moreover, it is possible to further secure this thread connection by way of adhesive, since it is not necessary to untighten the pin subsequently. It is also possible to attach the pin by any different way to the chain link, for example by way of a press fit, adhesive only, etc. Preferably, the socket is an integral part of the bridge. For example, the socket may be a simple bore in the bridge. It is preferred to have a bore manufactured after the die casting process, to just having an opening formed by die casting, in order to have close tolerances between the pin and the socket bore. Alternatively, the socket may be formed separately and attached to the bridge.

Preferably, the resilient locking element is a wire locking spring. The spring can be fixed to the bridge and engaging an engagement surface of the pin. The engagement surface of the pin preferably is a groove which is formed in the pin. The upper flange or wall of the groove may serve as the engagement surface. The wire locking spring is preferably made from stainless steel in order to avoid any corrosion, etc. Preferably the wire locking spring is resiliently clipsed or snapped on to the bridge. Preferably, the wire locking spring is W-shaped. Recesses can be provided on the bridge for engagement with the spring. Thus, the spring can easily be snapped on the bridge during manufacture. Preferably, the snap-on direction of the spring onto the bridge is substantially perpendicular to the snap on direction between pin and socket. Thus, a secure engagement of spring and bridge in the locking direction of pin and socket can be secured.

Preferably, the top of the pin is tapered. The taper of the top of the pin allows to slide the bridge onto the pin without requiring any tool. The tapering surface urges the spring out of its position against the bias of the spring. Once the spring is moved beyond the engagement surface of the pin, the spring moves back towards its original position and locks the bridge in place, resulting in a clear audible noise signalling to the service technician that the bridge has correctly been mounted.

One of the problems which arise in this type of conveyors is to provide a moving flange which is thin and stable and which is designed for the lifetime of the conveyor. For example, the German TÜV tests the moving flange by applying a force of 1.500 Newton perpendicular to the moving flange. With such force, the deviation of the moving flange must be less than 4 mm with total recovery once the force is no longer present. In order to secure integrity of the exposed surface as formed by the discs and the bridges, it has already been suggested to provide a groove and tongue engagement between the discs and the bridges (see WO 02/44071 A1). Such a groove and tongue engagement can be of a relatively loose fit with sufficient clearance there between so that there is practically no or little contact only between the tongue and the groove surfaces. Nevertheless, in order to secure the required clearance between the groove and tongue machining of the surfaces of at least one of the groove and tongue is required. Such machining is, however, substantially adding to the cost particularly with parts like bridges, which can generally be used directly after the die casting manufacturing step or after uncomplicated machining only.

Thus, the object to the engineers was to reduce the manufacturing cost for the flange parts while providing a good quality surface at the groove and tongue engagement.

This object has been solved by providing an insert made from a plastic material at the engagement surface between bridge and disc. It is known that good quality surfaces can be produced by plastic injection moulding at reasonable cost. It has turned out that, while this insert is an additional part and, providing such an insert can substantially reduce manufacturing cost. Various plastic material can be used. Plastic materials with good sliding capabilities relative to aluminium are preferred, since the flange parts are typically made from die cast aluminium. Particularly preferred are plastics like DELRIN 500AL NC (from the company Du Pont) and alternatively materials including a chemical lubricant and/or being Kevlar modified like DELRIN 500CL NC or DELRIN 500KM NC.

Preferably, the insert is clipsed or snapped onto the disc or bridge. Alternatively, the insert can be injection moulded directly onto the perspective part. It is particularly preferred that the tongue is located on the bridge. It is also preferred to attach the insert onto the tongue.

Preferably, the clip or snap connection includes snap recesses which are provided in the tongue of the bridge wherein the mouth of such recesses is directed essentially radial with respect to the circular shape of the tongue.

Thus the snap connection can provide a positive fixture of the insert in the circumferential direction, i.e. the direction of relative movement between disc and bridge. It is to be noted that the direction of the snap recesses can deviate to some extent from the precise radial direction. It is sufficient if the snap connection can provide a positive fixation in the circumferential direction. Practically, a plurality of snap recesses is provided for each insert with one of the central recesses being oriented relatively precisely in the radial direction and the further recesses being oriented essentially parallel to this central recess. Such a construction allows easy mounting of the insert in the same snap direction. This attachment method can also be applied if the tongue is provided at the discs.

It may also be preferred to have an insert on both the bridge and the disc. This is particularly preferred if a good surface quality is required also with the engagement surface of the respectively other component.

BRIEF DESCRIPTION OF THE DRAWINGS

The invention an embodiments of the invention are described in greater detail below with reference to the figures, wherein.

DETAILED DESCRIPTION

Figure 1:
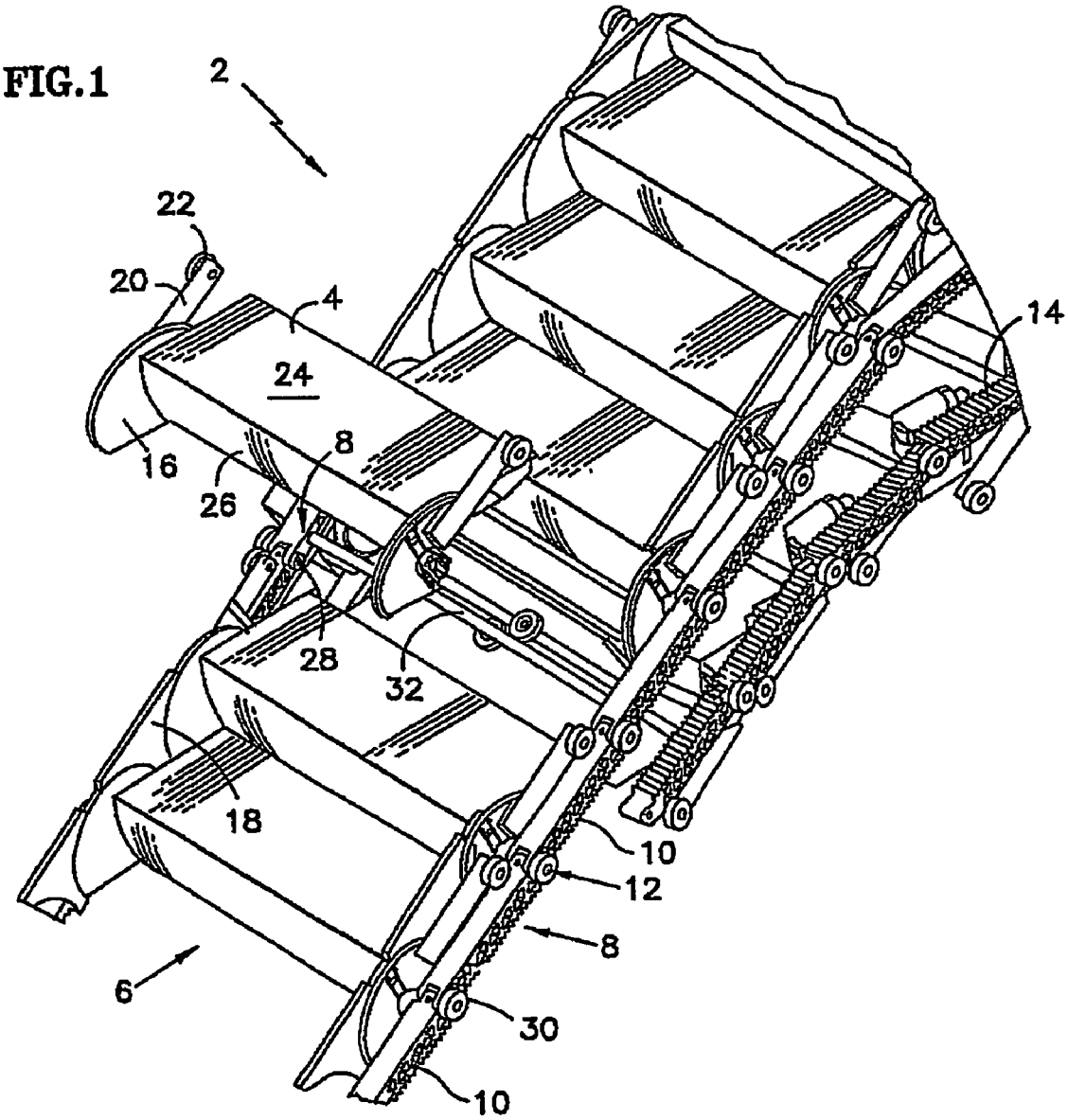
FIG. 1 shows a portion of a passenger conveyer according to the present invention.

FIG. 1 shows an inventive passenger conveyer 2 with an endless passenger conveyer band 6 that is composed of several interconnected tread elements 4. The tread elements 4 are connected to drive chains 8 that are respectively arranged laterally of the tread elements 4 and consist of a series of chain links 10. The chain links 10 are connected to one another at pivots 12. The passenger conveyer 2 is driven by a conveyer drive, for example a linear drive, etc. The drive engages a toothing 14 of the chain links 10.

In FIG. 1 the shown passenger conveyer 2 consists of an escalator. On escalators, the passenger conveyer band 6 is referred to as a step band, and the tread elements 4 are referred to as steps. FIG. 1 mainly shows the step band 6, the drive chain 8 and chain and step rollers 30 and 22, respectively. Thus, roller guide tracks, etc. are not shown in FIG. 1. One of the steps 4 is removed from the step band 6. For the particular construction which allows for easy removal of the step 4 from the step band 6, reference is made to WO 02/44072 A1. The step 4 contains a lateral flange element, i.e. disc 16 that moves together with the step 3. The discs 16 are rigidly fastened on step 4, wherein a second type of flange element, i.e. bridge 18, is respectively arranged between two succeeding discs 16. The bridges 18 bridge the interstice between consecutive discs 16 and are connected to the drive chain 14 as detailed below. The bridges 18 may also be attached to any other structural part moving together with the steps 4 and chain 8.

The discs 16 have a circular shape with the pivot or attachment point 12 of step 4 being the center of the circle. Correspondingly, the bridges 18 have correspondingly shaped circular edges. A groove and tongue engagement is provided at the contacting surfaces of the discs 16 and bridges 18 for maintaining the integrity of the exposed surfaces of bridges 18 and discs 16. With such construction the bridges 18 are attached to the chain links 10 exactly in the middle between consecutive pivots 12.

The steps 4 are moved in a revolving fashion by the drive chains 8. Step rollers 22 arranged at arm 20 serve for controlling the position of the stepping surface 24 of the step 4. The step roller 22 is guided in a guideway or guide track (not shown). The guide track follows a predetermined curve for the step roller 22 such that the position of each tread element 4 is defined in a compulsory fashion. During such movement discs 16 and bridges 18 translate relative to each other in the transitional areas and the reversal region.

As mentioned above, step 4 contains the stepping surface 24 and a step front side 26 that is also referred to as the "riser". The individual chain links 10 of the drive chains 8 are connected at the pivots 12 by means of short axial bolts 28. Chain wheels 30 are rotatably arranged on the outside of the axial bolts 28.

Two chain links 10 of the left and the right step chains 8 which are identically arranged relative to the step 4 are rigidly connected to one another by means of a connecting axle 32. The connecting axle 32 does not protrude out or beyond the chain link 10. Each step 4 has a lateral holding device by means of which it is connected to a drive chain 8. Regarding the particular construction, reference is made to WO 02/44072 A1. With such construction it is relatively easy to disassemble steps 4 from the step band 6 even at locations remote from the region reversal at the upper and lower landings, respectively.

It is to be noted that while the present invention is being described herein with respect to an escalator, it is also applicable in a moving walkway.

Figure 2:
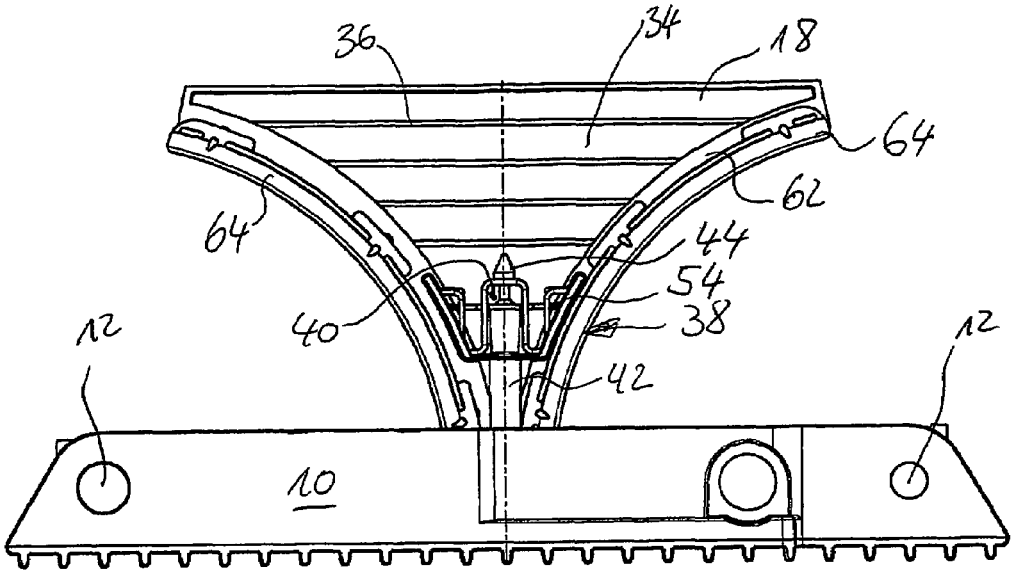
FIG. 2 is a view of a bridge which is attached to a chain link in accordance with the present invention.
Figure 3:
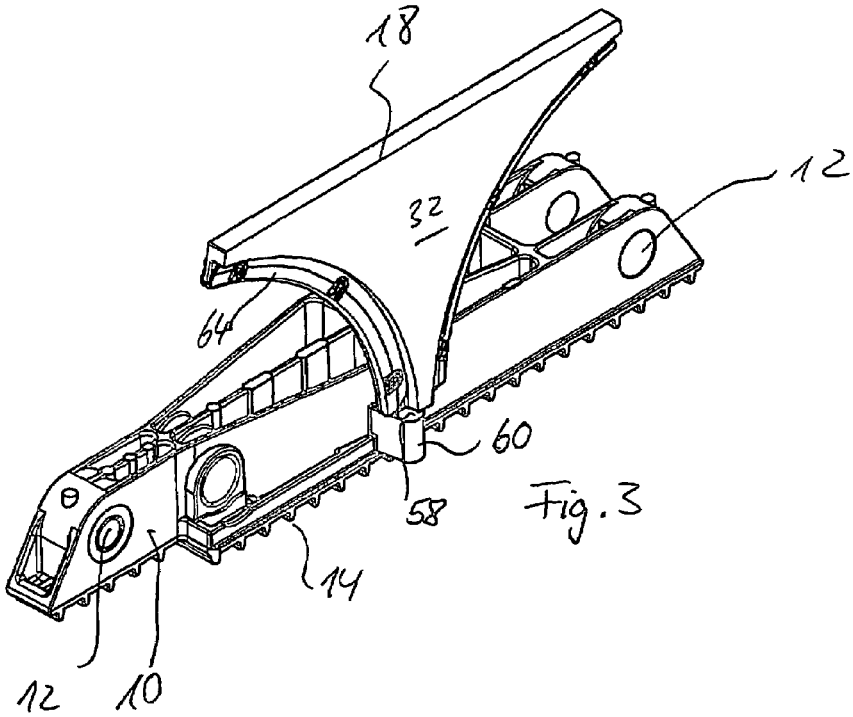
FIG. 3 is a perspective view similar to that of FIG. 2.

FIGS. 2 and 3 show details of the chain link 10 and bridge 18. Particularly, FIG. 3 shows the exposed face 32 of the bridge 18, i.e. the face which can be seen by the passenger who is standing on the step band 6. FIG. 2 shows the reverse side 34 of the bridge. Reinforcement ribs 36 are arranged so as to provide the structural stiffness for the bridge 18.

Particularly, the bridge 18 is attached by means of a pin and socket connection 38 to the chain link 10. The socket is essentially comprised of a bore 40 in the interior of a cylindrical element 42 which is cast integrally with the bridge 18. A pin 44 is positioned in bore 40 and retained in position by way of a wire locking spring 54.

Figure 7:
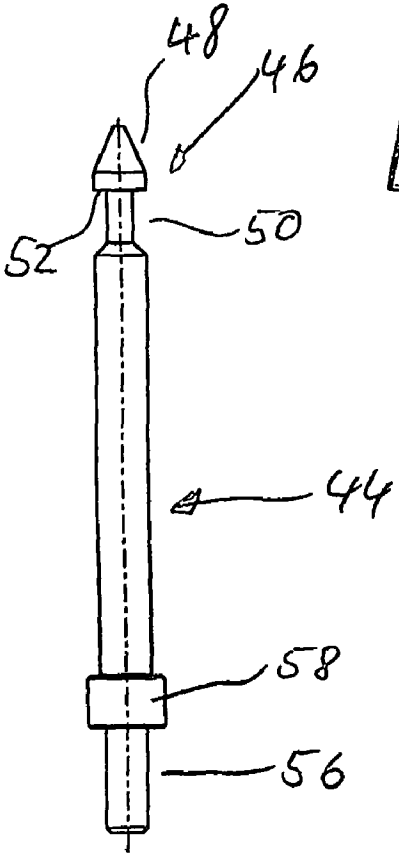
FIG. 7 is a detailed view of the pin for the pin and socket connection according to the present invention.

Reference is made to FIG. 7 which is a detailed view of the pin 44. Pin 44 has a head portion 46 including a taper 48 and a reduced portion 50. The reduced portion 50 forms an engagement surface 52 for engagement with the locking spring 54. The lower end 56 of the pin 44 is threaded. A lock nut 58 is provided at the threaded portion 56. The threaded portion 56 of the pin 44 is threaded into the protrusion 60 (see FIG. 3) on chain link 10.

The locking spring 54 has a substantially W-shaped form. It is snapped with its lateral ends into the circular edges 62 of the bridge 18 in a way that it is positively locked against movement in the direction of pin 44 by engagement surfaces of the bridge.

For unlocking the bridge element 18 it is sufficient to bring a screw driver in engagement with the locking spring 54 adjacent to the head 46 of pin 44 and to advance the screw driver towards the chain link 10. By doing so, the taper of the screw driver moves the locking spring 54 out of engagement with the engagement surface 52. It is then easily possible to lift the bridge 18 off. Vice versa for assembling the bridge 18 to the chain link 10, pin 44 needs to be inserted in bore 40. By way of pressing down the bridge 18, the locking spring 54 comes in contact with the taper 48 of pin 44. In the course of further movement of bridge 18, the locking spring 54 slides behind the engagement surface 52 and secures bridge 18 in position. In doing so, the resilient force of the spring pushes it heavily against the reduced portion 50 of pin 44 resulting in a clearly audible noise which signals the correct attachment of bridge 18 to the service technician. The locking spring 54 biases the bridge against the chain link 10.

In order to facilitate mounting of the bridge 18 to link 10, and moreover in order to further bias the bridge 18 against the chain link 10, it is preferred to have a resilient element (not shown) next to or instead of the lock nut 58. The resilient element may be any type of spring or can be made of a resilient material.

It is to be noted that as viewed from above downwards in the direction of pin 44, the reinforcement ribs 36 overlap pin 44 at least partially. As it is not necessary to turn or screw the pin with a tool, there is no need for providing a bore or cut-out in the enforcement ribs 36.

Figure 4:
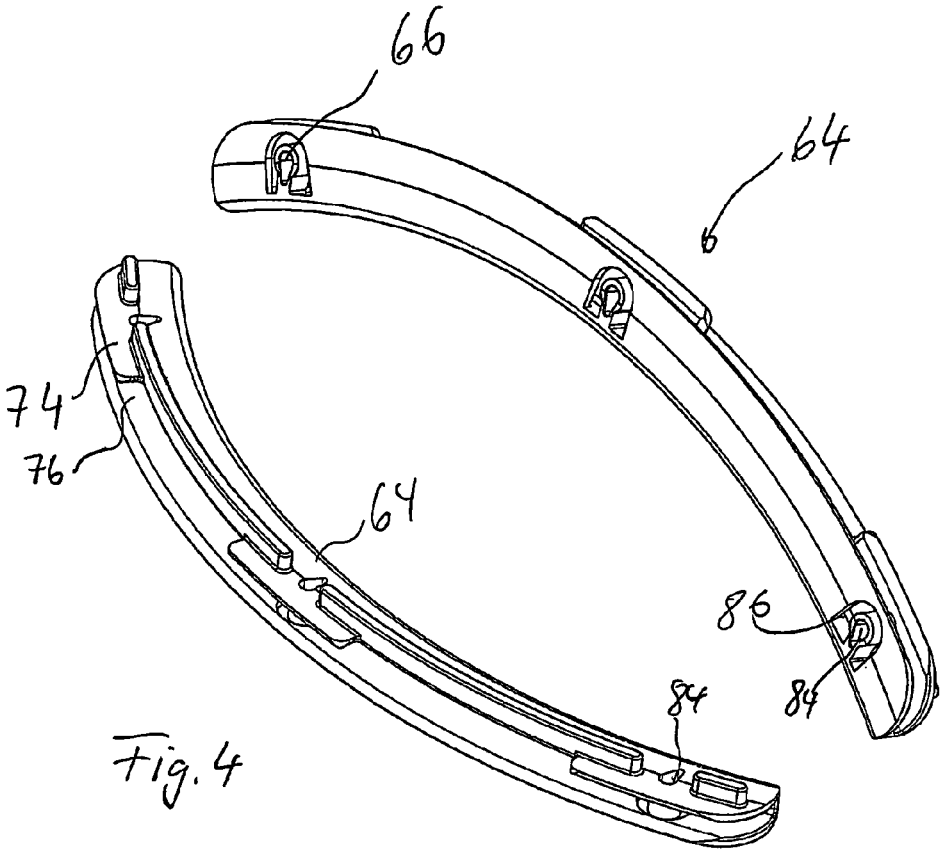
FIG. 4 shows a pair of inserts according to the present invention.
Figure 6:
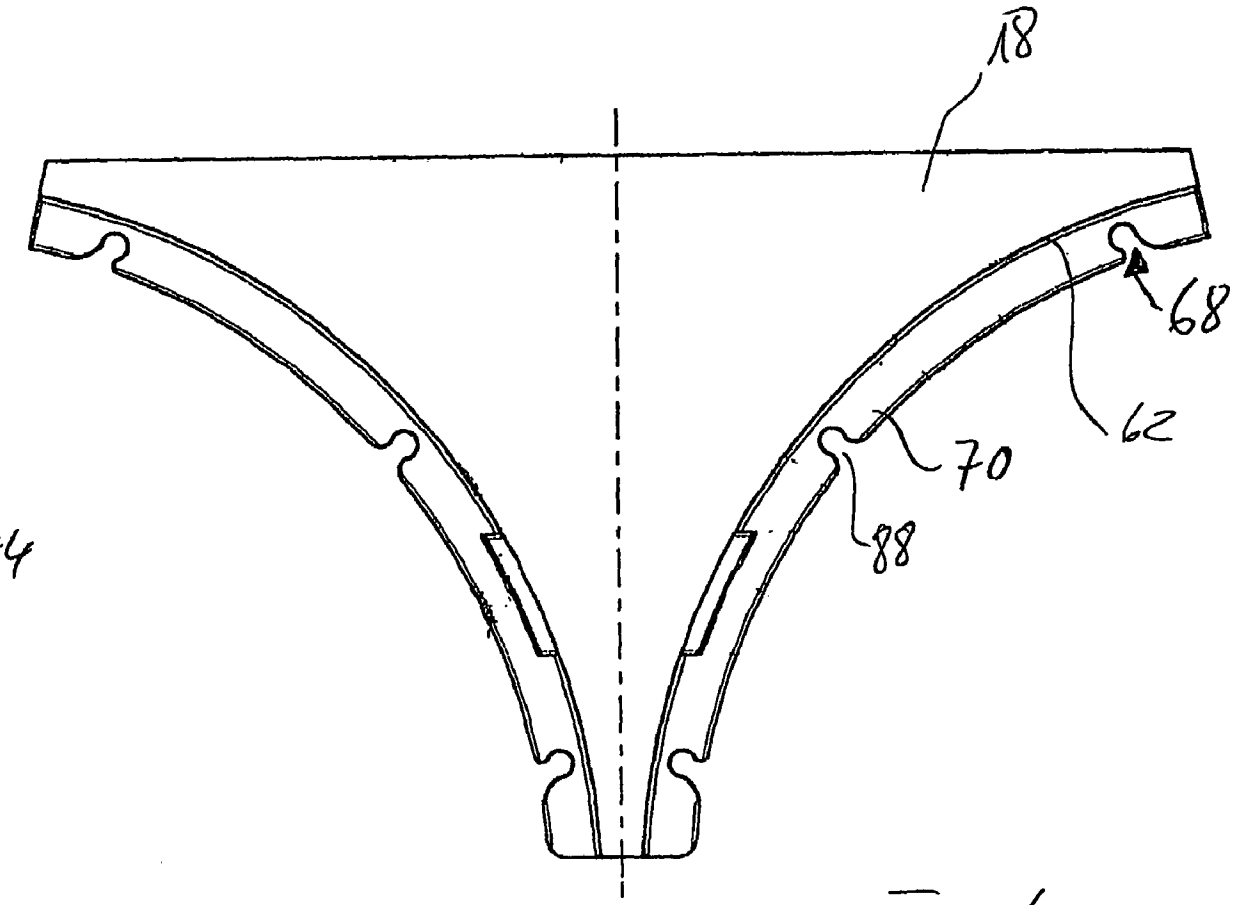
FIG. 6 shows a bridge according to the present invention without an insert attached thereto.

Fixed to the circular edges 62 of the bridge 18 is one insert 64 each. Particularly, the inserts 64, which are shown in more detail in FIG. 4, are of an essentially U-shaped cross section and comprise snap elements 66 for engagement with correspondingly formed snap recesses 68 (see FIG. 6) in the tongue 70 of a groove and tongue engagement between bridge 18 and disc 16. The corresponding groove (not shown) is formed in the disc 16. The tongue 70 is formed in circular shape along the circular edges 62 of bridge 18.

Figure 5:
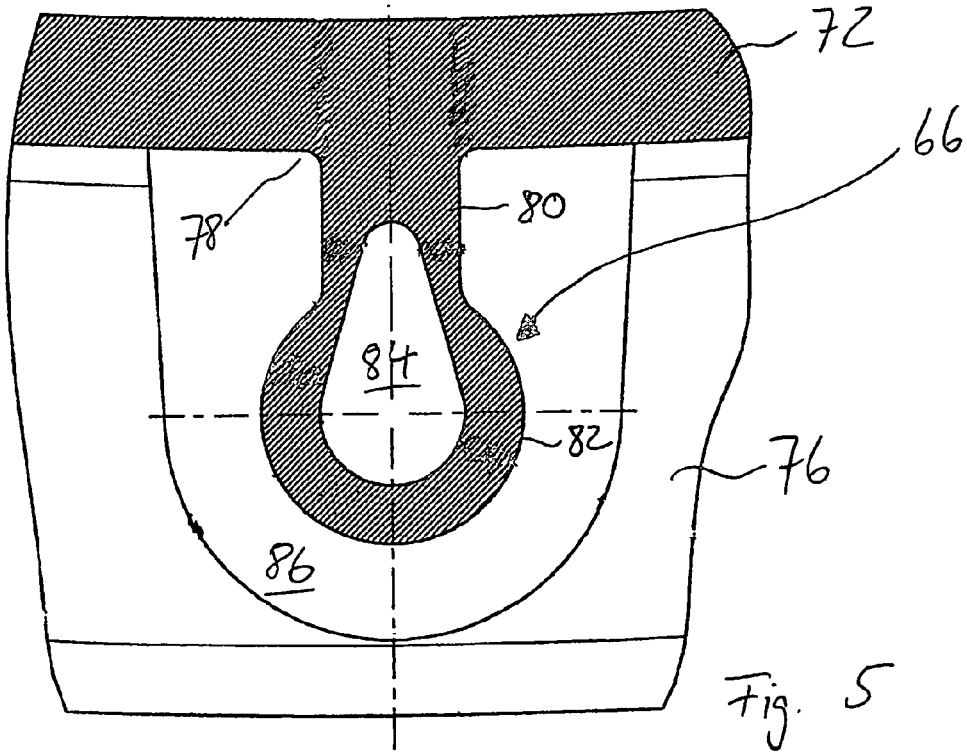
FIG. 5 is a sectional view showing the snap detail.

Snap element 66 is shown in detail in FIG. 5. FIG. 5 is a sectional view of the insert 64, particularly a section parallel to the two flanges of the U-shaped insert 64 through a snap element 66 and a web 72 which is connecting the two flanges 74, 76 of the U. The snap element 66 connects at location 78 to the web 72. The snap element 66 has a stem portion. 80 and a cylindrical portion 82. A drop-like through-opening 84 is provided in the snap element 66 in order to provide for a certain flexibility thereof. Stem portion 80 and cylindrical portion 82 are integrally formed with the web 72 and one of the flanges, i.e. flange 74 in FIG. 4. In the opposite flange 76 a cut-out 86 is provided around the snap element 66. Thus, stem portion 80 and cylindrical portion 82 are not attached on this side. This construction further enhances flexibility of snap element 66.

The three snap elements 66 of insert 64 are arranged essentially in parallel to each other, i.e. the stem and cylindrical portions 80, 82 respectively, of the individual snap means 66 protrude in parallel to each other from web 72. Similarly, the snap recesses 68 are arranged essentially in parallel to each other. This orientation of the snap element 66 and snap recesses 68 facilitates assembly of the insert 64 to bridge 18. One may notice in FIG. 6 that each snap recess 68 has a mouth 88. During snap-on, each snap element 66 is pressed through a mouth 88 which provides an opening which is somewhat smaller than the outer diameter of the cylindrical element 82. Due to flexibility of the snap element 66 the snap element 66 can be moved through the mouth 88 into the snap recess 68 and locks the insert 64 in position.

The invention claimed is:

1. Passenger conveyor including an endless conveyor band comprising:

a plurality of tread elements connected to and driven by a drive chain at each lateral edge thereof;

a moving flange moving in use together with the conveyor band, the moving flange including a plurality of discs attached to the tread elements and a plurality of bridges each attached between two consecutive discs, at least one bridge is attached to the drive chain by means of a pin and socket connection and that a resilient locking element is arranged so as to bias in use the bridge against the chain.

2. Passenger conveyor according to claim 1, wherein the drive chain is made up from a plurality of chain links hingedly connected to one another and the pin is attached to a chain link.

3. Passenger conveyor according to claim 2, wherein the pin is threaded into the chain link.

4. Passenger conveyor according to claim 1, wherein the socket is an integral part of the bridge.

5. Passenger conveyor according to claim 1, wherein the resilient locking element is a wire locking spring fixed to the bridge and engaging an engagement surface on the pin.

6. Passenger conveyor according to claim 5, wherein the wire locking spring is W-shaped and resiliently snapped onto the bridge.

7. Passenger conveyor according to claim 1, wherein the top of the pin is tapered.

8. Passenger conveyor according to claim 1, wherein a groove and tongue engagement is provided between bridge and disc and wherein an insert made of a plastic material is provided between bridge and disc.

9. Passenger conveyor according to claim 8, wherein the insert is snapped onto the disc or bridge.

10. Passenger conveyor according to claim 8, wherein snap recesses are provided in the tongue of the disc, wherein the mouth of such recesses is directed essentially radial with respect to the disc.

* * * * *